US006182957B1

(12) United States Patent
Becker

(10) Patent No.: US 6,182,957 B1
(45) Date of Patent: Feb. 6, 2001

(54) APPARATUS AND METHOD FOR HOLDING A FLEXIBLE PRODUCT IN A FLAT AND SECURE POSITION

(75) Inventor: Ronald Joseph Becker, Endicott, NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/373,461

(22) Filed: Aug. 12, 1999

(51) Int. Cl.[7] ..... B25B 11/00
(52) U.S. Cl. ..... 269/21; 269/11; 269/329
(58) Field of Search ..... 269/21, 329, 11; 279/3; 451/388

(56) References Cited

U.S. PATENT DOCUMENTS

| | | | | |
|---|---|---|---|---|
| 3,661,683 | * | 5/1972 | Engel et al. | 269/21 |
| 3,729,206 | * | 4/1973 | Cachon et al. | 269/21 |
| 3,742,802 | | 7/1973 | Maerz . | |
| 3,945,879 | * | 3/1976 | Fletcher et al. | 269/21 |
| 4,368,908 | | 1/1983 | Gentzel, Jr. . | |
| 4,463,636 | | 8/1984 | Heller et al. . | |
| 4,695,044 | * | 9/1987 | Nishihama et al. | 269/21 |
| 4,761,876 | | 8/1988 | Kosmowski . | |
| 5,546,654 | | 8/1996 | Wojnarowski et al. . | |
| 5,564,682 | * | 10/1996 | Tsuji | 269/21 |
| 5,660,380 | | 8/1997 | Reis et al. . | |
| 5,671,910 | | 9/1997 | Davies et al. . | |
| 5,727,434 | * | 3/1998 | Dils et al. | 269/21 |
| 5,782,152 | | 7/1998 | Reis et al. . | |
| 5,800,661 | | 9/1998 | Reis et al. . | |
| 5,857,667 | * | 1/1999 | Lee | 269/21 |

* cited by examiner

*Primary Examiner*—Robert C. Watson
(74) *Attorney, Agent, or Firm*—Scully, Scott, Murphy & Presser

(57) ABSTRACT

An apparatus for retaining a product, preferably such as a flexible product in a flat and secure position on a generally planar surface. More specifically, the apparatus consists of a self-contained multi-zone vacuum chuck fixture which is adapted to enable the selectively controlled securing and holding of flexible products possessing various sizes and configurations on a flat work surface. The apparatus may be transparent so as to be also utilized as a light table.

9 Claims, 3 Drawing Sheets

FIG. 5
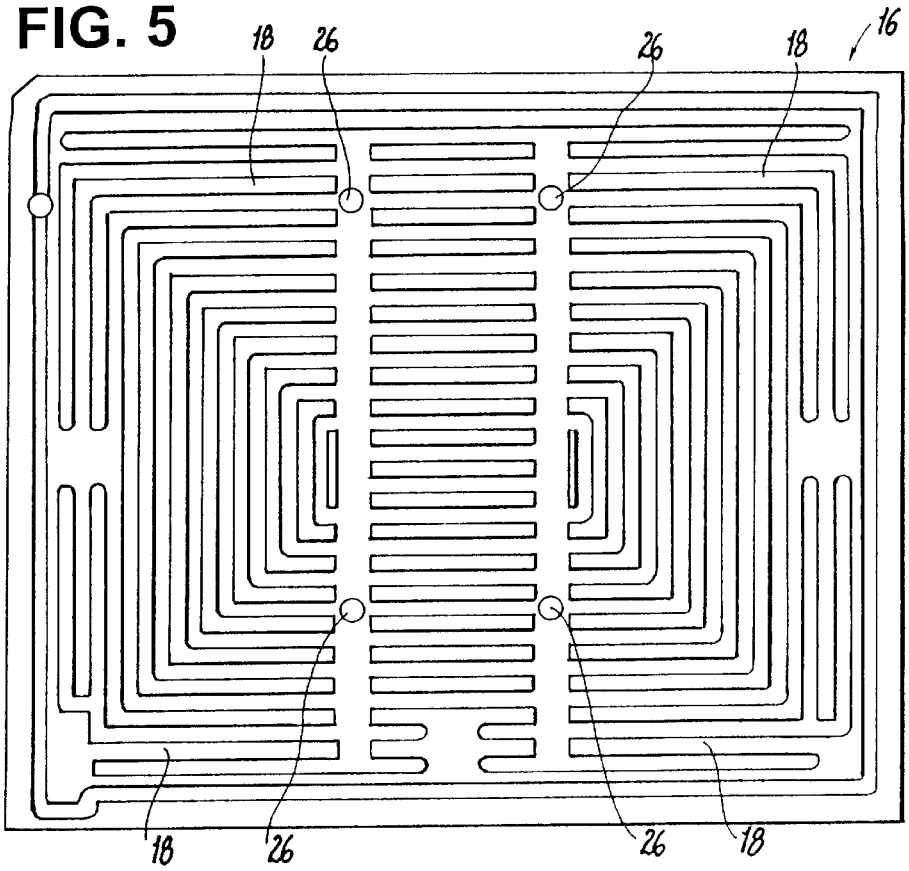
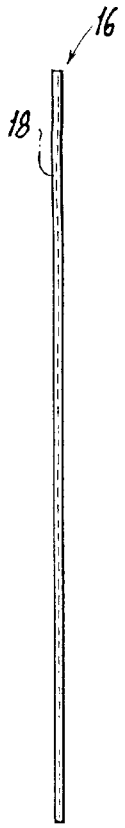
FIG. 6
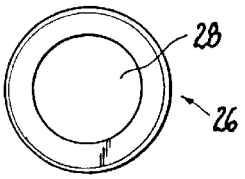
FIG. 8
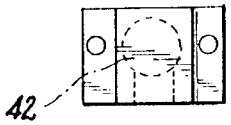
FIG. 11
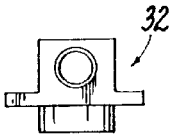
FIG. 10
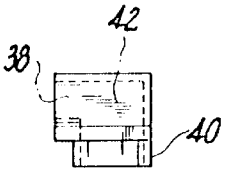
FIG. 9
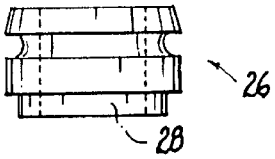
FIG. 7
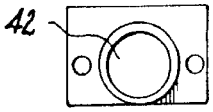
FIG. 12

APPARATUS AND METHOD FOR HOLDING A FLEXIBLE PRODUCT IN A FLAT AND SECURE POSITION

BACKGROUND OF THE INVENTION

1. Field of the Invention

The present invention relates to an apparatus and method for retaining a product, preferably such as a flexible product in a flat and secure position on a generally planar surface. More specifically, the invention pertains to an apparatus which consists of a self-contained multi-zone vacuum fixture which is adapted to enable the selectively controlled securing and holding of flexible products possessing various sizes and configurations on a flat work surface, and to a method of utilizing the apparatus.

The utilization of vacuum fixtures for the retention or adherence of various products possessing different sizes and configurations on planar surfaces is well-known in diverse technologies. Basically, the concept for retaining such products on surfaces, which pertains to a form of vacuum chucks adapted to enable the processing of such products through the provision of apertured product supporting surfaces which communicate with a source of a vacuum through suitable conduits, channels or openings, and which may provide for templates to impart a vacuum accommodating panel form factor and personalization in the retention of the various objects or products on the surfaces which communicate with the vacuum source.

Generally, such vacuum holding arrangements or systems which retain products or elements which are to be treated or processed on support surfaces under the application of a sub-atmospheric pressure or vacuum are constituted of metallic or opaque materials which, although they facilitate the secure positioning of the product or item on the support surface, do not permit for visual inspection and visual access to all sides of the specific product or item.

2. Discussion of the Prior Art

Currently, numerous types of vacuum fixtures and apparatuses are known in technologies which serve different purposes in order to meet various kinds of manufacturing requirements; for instance, such as applications directed to drilling, printed circuit board manufacturing steps, or for applications where extremely precise workpiece or product processing is required.

Reis, et al., U.S. Pat. Nos. 5,800,661, 5,782,152 and 5,660,380, which are based on a common disclosure, each disclose vacuum fixtures and methods for dimensioning and manipulating patterned materials. The material supporting surfaces are comprised of flat panels communicating through the intermediary of suitable apertures with a vacuum source so as to enable positioning of the patterned materials which are to be processed or treated while retained thereon in a precise and selective manner fail to provide transparent structure and the ability of utilizing back lighting in order to enable visual inspection of the items or materials being retained on the vacuum fixtures. Moreover, the patents each describe the utilization of a single-chamber vacuum fixture which does not facilitate the utilization of multi-zonal or selectively switchable areas subjected to a vacuum in order to be able to position different types of patterned materials thereon for processing or treating purposes.

Wojnarowski, et al., U.S. Pat. No. 5,546,654 discloses a vacuum fixture and method for the fabrication of electronic assemblies, which is constituted of either steel or various metal alloys. Although this fixture provides a vacuum chuck, it does not enable the inspection of the items or products arranged thereon and being processed from being inspectable from all sides due to the inability of the apparatus of being transparent to facilitate back lighting therethrough. Furthermore, this particular patent describes only a single vacuum chamber arrangement and consequently is unable to selective accommodate the vacuum retention of products of differing sizes and configurations.

Davies, et al., U.S. Pat. No. 5,671,910 describes vacuum plates which are adapted to be utilized in conjunction with a vacuum chuck for positioning material thereon, wherein the vacuum plates are constructed of either steel and aluminum, and consequently do not enable the unhindered visual inspection or accommodating of back lighting in order to facilitate the viewing of the material from all sides thereof.

Kosmowski, U.S. Pat. No. 4,761,876 relates to a high-speed precision drilling system which incorporates a vacuum chuck in order to retain a component thereon which is to be processed. The vacuum chuck is constituted of a material which is not transparent and does not facilitate the back lighting to enable viewing the component being drilled from all sides thereof. Furthermore, the system employed in this patent utilizes only a single vacuum chamber and one evacuation port, which will not enable the provision of multiple zones for treating parts or components of different sizes and configurations.

Heller, et al. U.S. Pat. No. 4,463,636 relates to a holding fixture and trimmer for processing the surfaces of a printed circuit board while retaining the circuit board on a support surface through the application of a vacuum. There is no provision of any transparent construction for the apparatus which will enable the viewing and back lighting of the printed circuit board which is being processed. Moreover, the fixture does not employ any switchable multi-zonal vacuum construction for treating differently sized and configured circuit board components.

Gentzel, Jr., U.S. Pat. No. 4,368,908 discloses a vacuum handling fixture which is constituted of steel and consequently does not permit for any lighting of a product which is positioned on a supporting surface under a vacuum. Moreover, the fixture is only equipped with a single vacuum chamber and one evacuation port, and consequently cannot be utilized as a multi-zonal or selectively switchable vacuum apparatus for differently sized and configured products.

Finally, Maerz, U.S. Pat. No. 3,742,802 discloses an apparatus which includes a vacuum holddown system for sheet material so as to enable the precision cutting of clothing. Provided is a steel vacuum plate with a plurality of holes communicating with a vacuum source, in which the lack of transparency of the plate fails to enable back lighting of the product which is being cut. Moreover, the vacuum chamber below the vacuum plate is comprised of a single area which is evacuated through a single port and fails to provide for multi-vacuum zones for treating components or sheets of difference sizes and dimensions.

SUMMARY OF THE INVENTION

Accordingly, in order to obviate or ameliorate the limitations encountered in the prior art, the present invention is directed to a vacuum chuck fixture or apparatus which is entirely transparent and enables a back lighting fixture forming a light table to be implemented so as to allow for inspection machining, for focusing through a flat support surface and facilitating top light, back light or both to impinge against a product being positioned thereon.

Moreover, the vacuum chuck pursuant to the invention has an adjustable working area which combines a panel form factor and provides for personalization in order to enable an efficient, effective and quiet operation, with the possibility of incorporating a sensor arrangement facilitating an automatic selection of the particular support surface areas to which a vacuum is to be applied to retain a specific kind of workpiece or product thereon. In essence, the inventive vacuum apparatus for holding a flexible product flat and secure enables the provision of a combination of a light table and vacuum chuck, the inspection of the product during operation and the use of microscopes, video cameras and a generic optical inspection to ascertain work conditions during product processing.

In order to enable the foregoing, there is provided a planar apparatus structure which includes a hollow interior providing for plurality of discrete channels whereby an upper flat plate surface includes a multiplicity of small apertures communicating with respectively various of the channels, and which, in turn, communicate selectively with a multizonal vacuum arrangement for applying a vacuum to predetermined areas of the apertured flat plate surface.

Inasmuch as the entire apparatus construction is essentially constituted of a transparent material, in which the unique characteristics thereof facilitate the use of back lighting and multiple vacuum-applying zones within the vacuum chambers connected to different ones of the channels, this facilitates switching from one product size to another without the need for modifying the apparatus.

In essence, the construction of the inventive vacuum apparatus is essentially that of a self-contained multi-zonal vacuum chuck fixture employing a two piece construction for the main body components of the fixture, and multiple back-mounted quick connect/disconnect vacuum ports communicating with a vacuum source. A back plate of the fixture contains a multiplicity of discrete internal channels facing a front plate for each respective zone, the latter of which is subjected to a vacuum by separate selectively actuable inlet nozzles or connectors. The front plate construction of the fixture may be a thin plate which is provided with a multiplicity of closely spaced vacuum holes arrayed about its surface. The fixture can be machined to extremely tight flatness tolerance requirements; and through the intermediary of separate vacuum lines being selectively connected to the vacuum ports or connectors, the fixture has the capability of accommodating a multitude of product sizes through the use of simple valving. The complete vacuum chuck fixture may incorporate clearance holes or slots to allow existing locators to protrude whereby it is possible to maintain a precise x and y location relative to an existing tool base plate on which the apparatus is located for processing the products.

The vacuum chuck fixture can be easily installed in and removed from processing apparatus without the need for accurate x and y location requirements. The self-contained multiple-channel vacuum zones of the fixture eliminate vacuum leaks and uncovered vacuum holes, which results in reduced operating noise and lower air consumption. Due to the novel fixture design and multiple vacuum inlet ports, there can be obtained extremely high flow rates for initial panel or support surface pulldown, and a high level of vacuum can be employed without deforming the fixture.

Accordingly, it is an object of the present invention to provide a self-contained multi-zone vacuum fixture for retaining products in a flat and secure position on a generally planar surface.

Another object of the invention resides in the provision of a vacuum fixture which is constituted of a substantially transparent material so as to concurrently constitute a vacuum chuck and a light table arrangement enabling the back lighting and unhindered visual inspection of a product.

A further object resides in a method for utilizing a vacuum fixture as described herein which incorporates a plurality of channels selectively communicating with a vacuum source through connector ports so as to facilitate selectively imparting a vacuum to different surface areas of the vacuum fixture in correlation with differently dimensioned and configured products being retained on the surface of the vacuum fixture under the effect of the vacuum.

BRIEF DESCRIPTION OF THE DRAWINGS

Reference may now be had to the following detailed description of a preferred embodiment of the invention, taken in conjunction with the accompanying drawings; in which:

FIG. 5 illustrates top plan view of the back plate;

FIG. 6 illustrates an end view of the back plate of FIG. 5;

FIGS. 7 and 8 illustrate, respectively, side and end views of a connector grommet for a vacuum port of the apparatus; and FIGS. 9 through 12 illustrate, respectively, end and side views of vacuum inlet connectors which are attached to the apparatus.

DETAILED DESCRIPTION OF A PREFERRED EMBODIMENT

Figure 1:
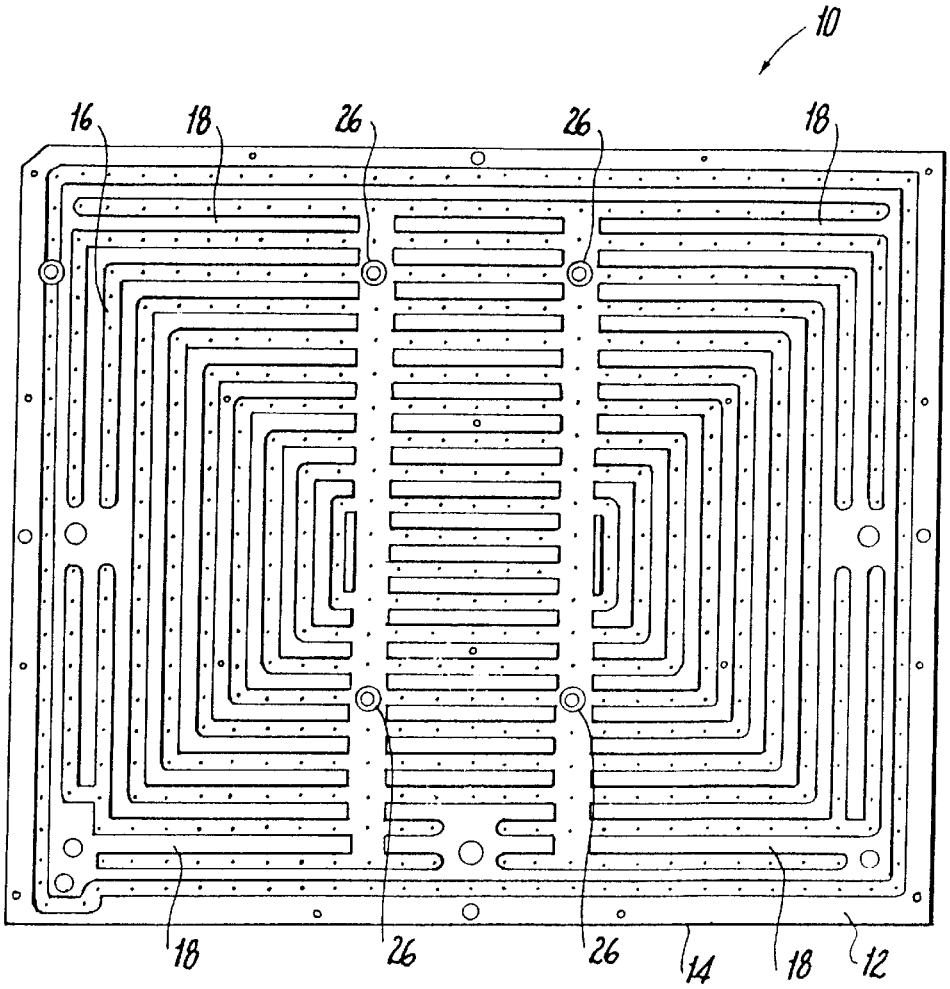
FIG. 1 illustrates a top plan view of a vacuum fixture apparatus pursuant to the invention.
Figure 2:
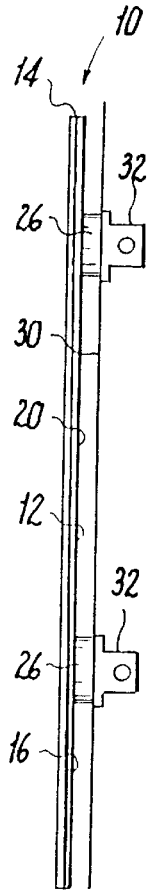
FIG. 2 illustrates an end view of FIG. 1.

Referring now in more specific detail to the drawings, and particularly to FIGS. 1 and 2, there is disclosed an apparatus 10, which is essentially a vacuum chuck for holding a flexible product flat and secure on an upper planar surface 12 thereof through the intermediary of the aspirating application of a sub-atmospheric pressure or vacuum.

In essence, the basic structure of the apparatus 10, which in this instance is shown to be of rectangular configuration in plan view, although other shapes, such as circular, oblong, oval or the like may also be applicable thereto, shows a first upper flat plate 14 possessing the top surface 12. A lower plate 16 is located in surface contact with a bottom surface 20 of plate 14, and includes a plurality of discrete channels 18 of different configurations and lengths extending between the contacting upper and lower plates 14 and 16.

Figure 3:
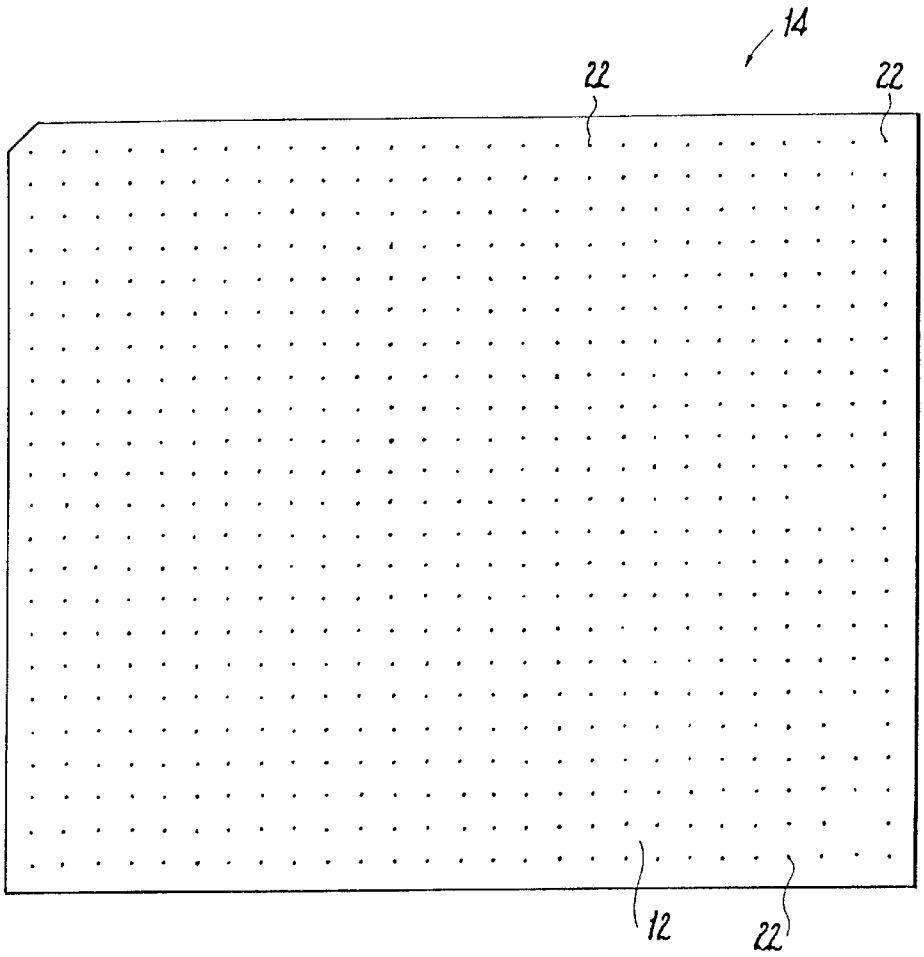
FIG. 3 illustrates a top plan view of the top plate of the apparatus.
Figure 4:
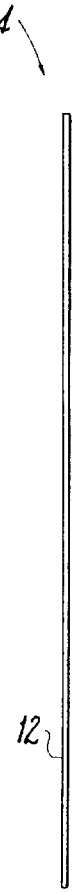
FIG. 4 illustrates an end view of the top plate of FIG. 3.

The lower plate 16 has a specified thickness, with the channels 18 being formed or molded therein, and which face the bottom surface 20 of the upper or top plate 14. The top plate 14 is a flat thin plate having a multiplicity of small closely spaced apertures 22 extending therethrough, as shown in FIGS. 3 and 4 of the drawings. The plates 14 and 16 may be adhesively and sealingly fastened together along their joint perimeters 24 so as to form a closed sandwich-like construction, and are each preferably constituted of a transparent and rigid plastic material.

Extending into the respective channels 18 which are present between the flat perforated plate 14, and protruding rearwardly through the lower plate 16 so as to project rearwardly therefrom, are a plurality of sealing elements 26, as shown in FIGS. 7 and 8 of the drawings. These elements 26 are essentially grommets forming a fluid or air-tight seal relative to the exterior of the apparatus 10 and are in aspirating fluid flow communication with the channels 18 between the upper flat apertured plate 14 and the lower plate 16 which has the interior channels 18 formed therein.

In essence, the cylindrical grommets 26 which form the sealing connectors projecting rearwardly of the bottom channeled plate 16, each have a central through-bore or aperture 28. These grommets extend through a further plate 30 so as to attach to conduit connectors or nozzles 32 which will enable sub-atmospheric pressure or vacuum conditions to be applied therethrough to the channels 18 and from there to the top surface 12 of plate 14 through the apertures 22.

As shown particularly in FIGS. 1 and 2 of the drawings, the conduit connectors 32 and the grommets 26 are spaced at specified locations about the confines of the apparatus so as to each communicate with respectively different ones of the channels 18, and to thereby provide vacuum or sub-atmospheric flow communication with different areas of the upper surface 12 of the top flat plate 14 in correlation with particular products, when a vacuum is applied thereto, as is described hereinbelow.

Connected to the bottom or lower protruding end 36 of each of the grommets 26 is one of the conduit connectors 32, as shown in detail in FIGS. 9 through 12 of the drawings, and which may be suitably screwed or fastened to the lower plate member 16 having the channels 18 formed therein. The connectors 32 each have angled portions 38, 40 with passageways 42 adapted to sealingly connect at one end with the protruding portion of each respective associated grommet 26, and with the other ends of the connectors 32 having attached conduits (not shown) leading to a source of vacuum through suitable valving (not shown).

Through the provision of either manually or automatically selectively actuated valving, it is possible to impart a vacuum to select area portions of the upper surface 12 of the apertured plate 14 by permitting the opened valve to enable a suctioning or aspirating flow of sub-atmospheric air to extend through an associated one of the grommets 26 and connectors 32. This will subject a specific one of the therewith associated discrete channels 18 which communicates with the select plate area portion to be subjected to the vacuum, while concurrently inhibiting any vacuum from being imparted to the remaining upper surface areas of the apertured plate 14.

As desired by particular apparatus configurations and processing conditions, and the size or configuration of the article or product being processed, such as a printed circuit board or the like, or any other component which is to be treated, the surface areas of the apertured plate 14 which are to be subjected to a vacuum at any specific time may be readily varied by suitably opening and closing of the valving arranged in the conduits leading to the connectors 32.

A particularly advantageous aspect of the invention resides in that the entire vacuum chuck fixture or apparatus 10 consisting of the upper apertured plate 14 and the channeled lower plate 16 which is fastened thereto in order to provide the sealed channeling arrangement, is transparent in nature, preferably by being constituted of a transparent rigid plastic material. Consequently, this enables the visual inspection of the product located on the plate 14 though the intermediary of back lighting; in essence, imparting the features of a light table to the apparatus.

In essence, the structure of the assembled upper and lower plates 14 and 16, forms a plurality of discrete channels 18 defining different zones which may be imparted a sub-atmospheric pressure or vacuum through the different inlet connectors 32. The front plate 14 may be thin, for example 0.125 inches in thickness, and equipped with a multitude of the small vacuum apertures 22 which are closely spaced to each other.

The bottom plate 16, which is of a thicker construction than plate 14 and which has the different channels 18 formed therein, may be chemically welded to the front plate 14, resulting in a very rigid but relatively thin vacuum fixture possessing, for example, a thickness of 0.5375 inches. This fixture can then be machined at its surfaces to very close flatness tolerance requirements.

The vacuum ports or connectors 32 which are preferably quick connect/disconnect in nature, may be welded to the back of the fixture or apparatus and, through the intermediary of separate vacuum conduits connected to these connectors and through the provision of simple valving, the entire vacuum fixture is adapted to accommodate a plurality or variety of different product sizes and configurations.

The foregoing apparatus, in essence, provides a unique vacuum chuck construction, which also concurrently constitutes a light table facilitating inspection during implementation of product processing, the use of microscopes and video cameras to monitor the process, and facilitating general optical inspection as required.

The invention in its use and due to its transparent nature, may be readily implemented through back lighting which allows for top light, back light or both, and with the precise flatness of the fixture enabling focusing for suitable inspection operations.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An apparatus for retaining a product in a flat and secure position on selective surface areas of a planar surface through the intermediary of a selectively applicable vacuum and for concurrently forming a light table; comprising:

(a) a vacuum chuck having an apertured plate of a light-permeable transparent material forming said planar product-supporting surface;

(b) a second plate consisting of said transparent material having a plurality of discrete channels formed therein sealingly fastened to said apertured plate such that said channels communicate each with respectively a specific said surface area of said apertured plate; and (c) a plurality of fluid flow connectors which communicate with a source of vacuum extending from a rear surface of said channeled plate, said fluid flow connectors each communicating with respectively one of said plurality of channels so as to facilitate the imparting of a vacuum to selective of said channels communicating with selective of said surface areas responsive to a vacuum being applied to one of said fluid flow connectors associated with said channel, and wherein the application of a backlight to said apparatus facilitates utilization thereof as the light table.

2. An apparatus as claimed in claim 1, wherein said transparent material consists of a rigid, high-strength plastic material.

3. An apparatus as claimed in claim 1, wherein each of said fluid flow connectors comprises a grommet extending through the rear surface of said channeled plate, each said grommet having a central through-aperture in fluid flow communication with a respective one of said plurality of channels.

4. An apparatus as claimed in claim 3, wherein a flow nozzle is connected to respectively each of said grommets, each of said flow nozzles being connectable to a conduit leading to a source of vacuum.

5. An apparatus as claimed in claim 4, wherein valving means are positionable in each said conduit for controlling the application of a vacuum to said plurality of channels and specified surface areas on said apertured plate.

6. An apparatus as claimed in claim 1, wherein said apertured plate and said channeled plate are sealingly fastened together along the perimeters of said plates.

7. An apparatus as claimed in claim 6, wherein said plates are sealing fastened together through welding.

8. An apparatus as claimed in claim 1, wherein said apertured plate and channeled plate are rectangular in surface configuration.

9. An apparatus as claimed in claim 1, wherein said channeled plate facilitates the application of a vacuum to said planar surface on said apertured plate in a selective multi-zone arrangement.

* * * * *

UNITED STATES PATENT AND TRADEMARK OFFICE

CERTIFICATE OF CORRECTION

PATENT NO. : 6,182,957 B1
DATED : February 6, 2001
INVENTOR(S) : R.J. Becker

It is certified that error appears in the above-identified patent and that said Letters Patent is hereby corrected as shown below:

Title page,
[57] Abstract: After "apparatus" insert -- and method --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*